US009745022B1

(12) United States Patent
Kuenzel

(10) Patent No.: US 9,745,022 B1
(45) Date of Patent: Aug. 29, 2017

(54) SHALLOW WATER ANCHOR FOR A FISHING BOAT

(71) Applicant: Rainer Kuenzel, Hunt, TX (US)

(72) Inventor: Rainer Kuenzel, Hunt, TX (US)

( * ) Notice: Subject to any disclaimer, the term of this patent is extended or adjusted under 35 U.S.C. 154(b) by 0 days.

(21) Appl. No.: 15/428,300

(22) Filed: Feb. 9, 2017

Related U.S. Application Data

(60) Provisional application No. 62/389,072, filed on Feb. 17, 2016.

(51) Int. Cl.
*B63B 21/26* (2006.01)
*B63B 21/30* (2006.01)
*B63B 21/22* (2006.01)

(52) U.S. Cl.
CPC ..... *B63B 21/26* (2013.01); *B63B 21/22* (2013.01); *B63B 21/30* (2013.01)

(58) Field of Classification Search
CPC ..... B63B 21/26; B63B 21/22; B63B 21/30
See application file for complete search history.

(56) References Cited

U.S. PATENT DOCUMENTS

| | | | | |
|---|---|---|---|---|
| 2,162,796 | A * | 6/1939 | Beckmann | A47G 25/486 223/93 |
| 3,656,449 | A | 4/1972 | Mead | |
| 6,041,730 | A * | 3/2000 | Oliverio | B63B 21/26 114/230.13 |
| 9,284,024 | B2 | 3/2016 | Kuenzel | |
| 2003/0001056 | A1* | 1/2003 | Ihalainen | A61B 6/145 248/276.1 |
| 2004/0172883 | A1* | 9/2004 | Rogers | E05F 15/63 49/341 |
| 2011/0107952 | A1* | 5/2011 | Nicholson, IV | B63B 21/26 114/230.13 |

* cited by examiner

*Primary Examiner* — Stephen Avila

(57) ABSTRACT

In a shallow water anchor of a parallelogram design which lowers a rod down from a fishing boat into contact with the ground to keep a boat from drifting out of a chosen location, a depth the rod can reach depending on the combined extended length of the unfolded parallelogram and the length of the vertical rod, a first improvement to increase the maximal depth without concomitantly increasing the length of the parallelogram frame, the improvement using the relative motion and geometry of parallelogram parts to lengthen a telescoping rod, and a second improvement of a flexible coupling to an electric drive motor.

4 Claims, 14 Drawing Sheets

17
20
25
23
33
35
32
36
10
10
34
18
"D"
16
14
19
"L1"
17
"C"
20
2x"L1"
23
35
32
36
33
"L2"
26
25
17
22
23
34
24

"D"
"C"
"B"
"A"
50
25
23
52
55
59
58
57
56
17
51
54
53
24

FIG. 15
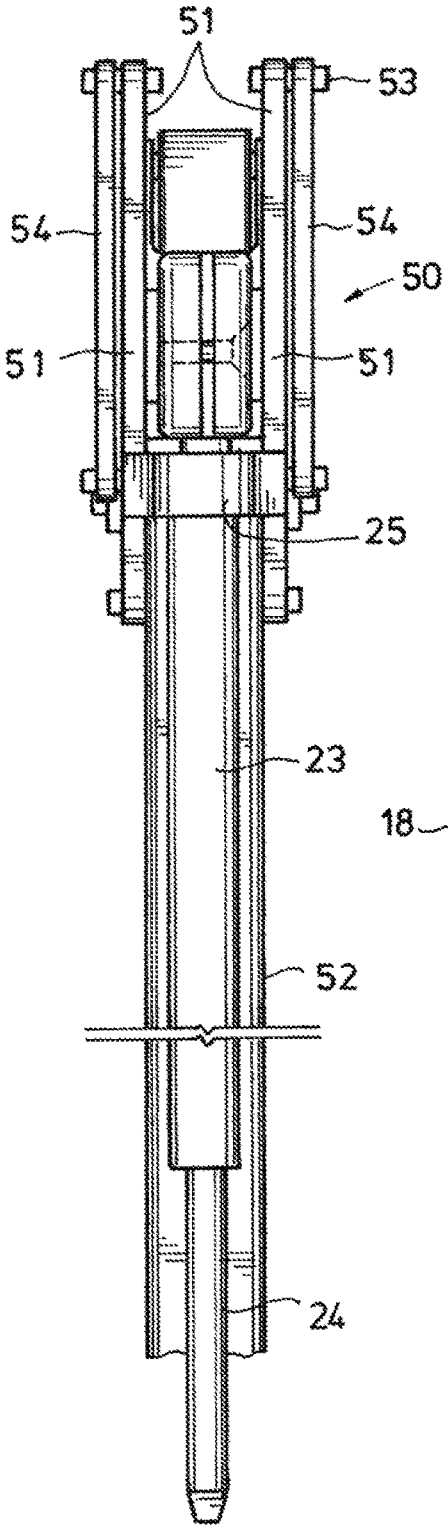
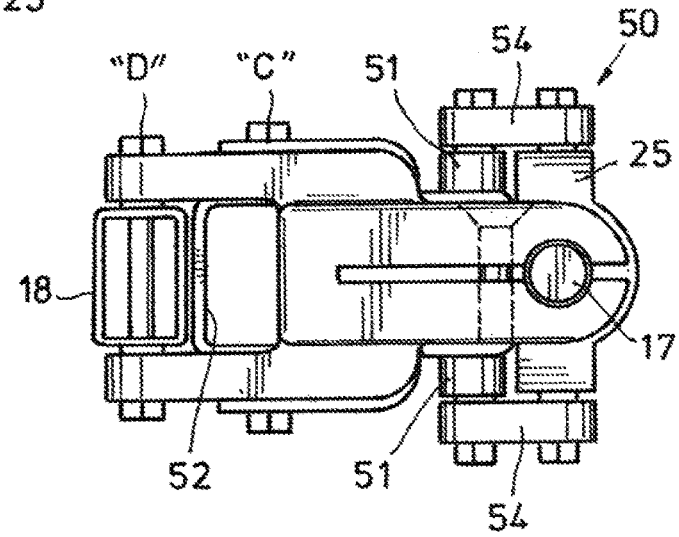
FIG. 16

SHALLOW WATER ANCHOR FOR A FISHING BOAT

This application relates to and claims priority to provisional application Ser. No. 62/389,072, filed Feb. 17, 2016, entitled Extension Attachment For Shallow Water Fishing Boat Anchors, having inventor Rainer Kuenzel. The contents of the referenced provisional application are herein and hereby incorporated by reference in their entirety.

FIELD OF INVENTION

This invention relates generally to the field of boat anchors and, more particularly, to a boat anchor for use in shallow water.

My prior U.S. Pat. No. 9,284,024 is herein and hereby incorporated by reference in its entirety, for background.

BACKGROUND OF INVENTION

Shallow water anchors presently available in the market typically include an objective to lower at least one rod, usually made from fiberglass, vertically from the stern of the fishing boat, into the water, until the rod reaches the bottom of a body of water, to hold the boat in position, and keep it from drifting away because of wind, current or wave action. Available anchors may use hydraulic cylinders or electric motors requiring a hydraulic pressure source or an electric power source to operate the motion of the anchor. In one case the anchor structure is always in an upright position (which can get in the way of the angler) and which lowers the rod vertically into the water very close to the stern of the boat, which is a disadvantage when two anchors are desired to keep the boat from weather-vaning because the two anchors are very close together.

It has further always been the desire of the users of such anchors to be able to reach the bottom in ever deeper waters. Consequently, the manufacturers of such anchors keep increasing the size of their designs, which inconveniently increases the height of the anchors at rest, the height by which they stick up in their upright retracted storage position. For example, if an anchor based on a parallelogram design (see patent incorporated by reference) is designed to reach a depth of, say, 10 feet, its height in storage position will be 5 feet, which is usually much higher than the highest point of the outboard motor.

A further disadvantage of existing shallow water anchors is the noise and vibration caused by its deployment by an electric motor.

SUMMARY OF THE INVENTION

It is therefore desirable to provide a parallelogram anchor design that will reach bottom in deeper waters without being increased concomitantly in height in the stored position, and whose deployment of its electric motor has the vibration and noise damped. The instant invention, as disclosed below and in the drawings, provides such structure.

BRIEF DESCRIPTION OF THE DRAWINGS

A better understanding of the present invention can be obtained when the following detailed description of the preferred embodiments are considered in conjunction with the following drawings, in which:

So that the manner in which the above recited features, advantages and objects of the present invention are attained and can be understood in detail, more particular description of the invention, briefly summarized above, may be had by reference to embodiments thereof which are illustrated in the appended drawings.

FIG. 15 illustrates right side view of FIG. 13.

FIG. 16 illustrates top view of FIG. 13.

DETAILED DESCRIPTION OF PREFERRED EMBODIMENT

Figure 1:
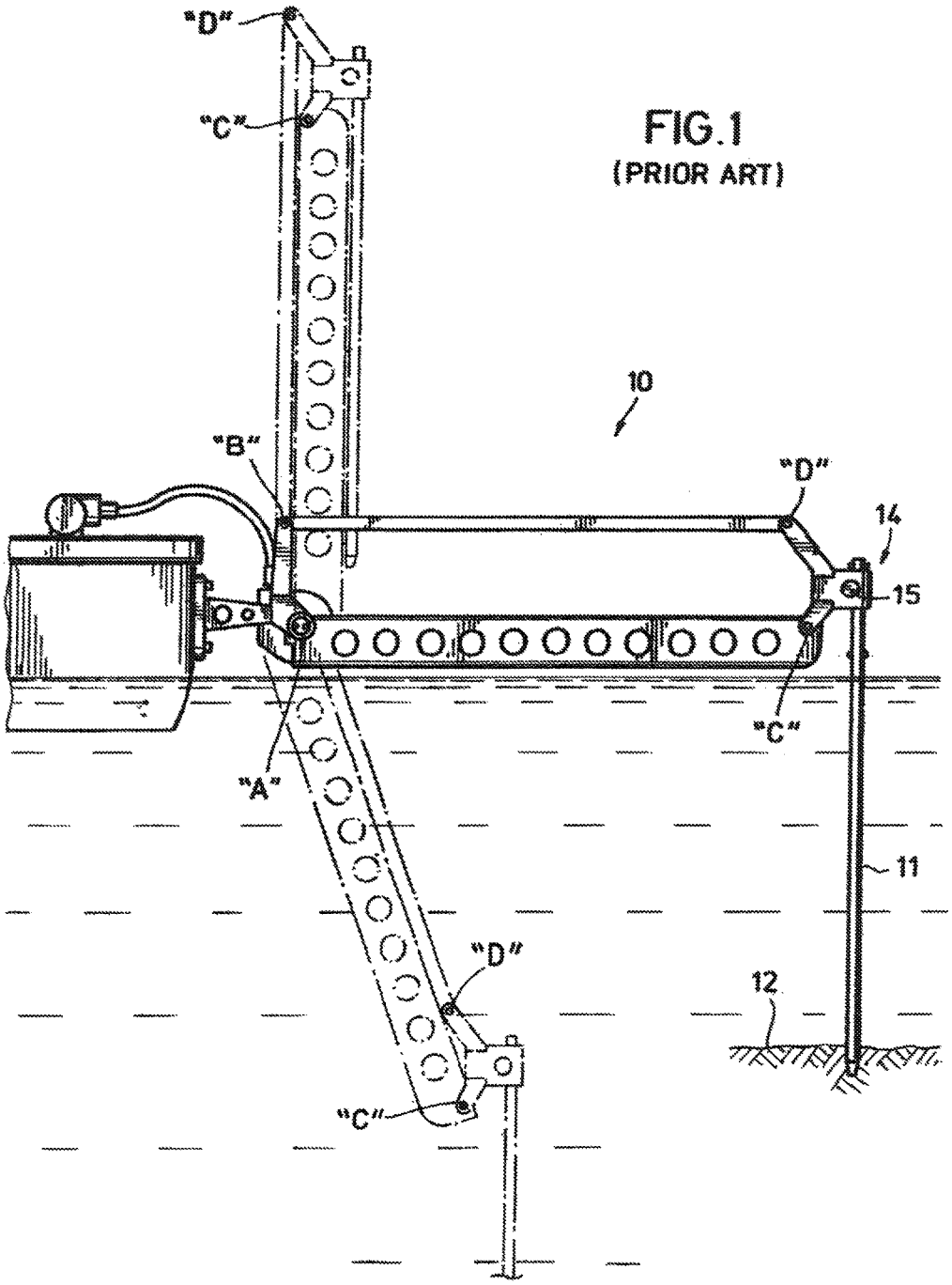
FIG.1 (PRIOR ART)
FIG. 1 illustrates side elevation view of the prior art.

Referring to prior art FIG. 1 and more particularly illustrated in U.S. Pat. No. 9,284,024, an anchor, preferably mountable to the stem of a shallow-water fishing boat, comprises a parallelogram beam, formed of a primary load-bearing beam, a secondary beam, and connecting arms. These four arms form a parallelogram with the corner points A, B, C and D. The connecting arm is an integral part of a mounting base. Therefore, points A and B are in a fixed position. The lengths of the arms are equal, and so are the lengths of the beams. This means that a rod attached as illustrated can always be vertical, or parallel to a base plate affixed to the stern of the boat, no matter in which direction the parallelogram is rotated. The base plate is an integral part of mounting base. The rod is arranged to be stuck into a lake bottom, provided the water is shallow enough. A primary beam is rotatably mounted to the mounting base at point A by a shaft. The arm includes a plate, which is slotted and is provided with a passage to hold the rod, preferably made of fiberglass. A hand-operated knurled knob serves to tighten the passage around rod to hold it firmly in place. Jam nuts prevent screws from getting accidentally unscrewed too far. To prevent the rod from sliding all the way out of the plate, a pair of pins are positioned above and below the plate. Note also that the rod may extend well above the plate so that the length of the rod extending below the plate (and thus into the lake bottom) may be adjusted as desired by the user.

A preferred electrical driving mechanism can be provided. The shaft extends through a yoke, which contains a worm gear, and to which the shaft is connected via a key. A hollow shaft surrounds the shaft and is connected to a lower end of the primary beam via a pair of bolts. A worm gear can be engaged to a worm, which in turn is rotated via a flexible shaft and an electrical geared motor. The rotation of the worm gear and the shaft is transmitted into the hollow shaft and therefore the primary beam by a torsion spring, thus representing a flexible connection between the electrical drive motor and the anchor arms. This flexible connection accounts for wave action acting on the boat while the rod is embedded in the lake bottom. One end of the torsion spring 50 is connected to an end of the shaft, and the other end of the torsion spring engages a slot of the shaft.

When the boat heaves up and down in wavy water conditions, the rod maintains contact with ground because beam parallelogram can rotate around the point A, using up or replenishing the stored torque of spring, providing wave compensation.

Such shallow water anchors as shown, for example, in the patent incorporated by reference, are used to anchor a fishing boat in lakes or rivers no deeper than 8 or 10 feet to prevent a boat from drifting away from a chosen location, to allow the angler to attend to the business of deploying hook a sinker, without having to pay attention to the motions of his boat, caused by wind or water currents.

Again, such anchoring (10), as shown in FIG. 1, typically consists of the parallelogram in which one of the shorter sides (A-B) is attached to the stern of the boat in fixed condition, and the other short side (C-D), therefore also in a non-rotational manner, carrying a rod (11), which is such held in an always vertical position, and always ready to contact the bottom (12) of the body of water, as the parallelogram anchor beam us rotated and its outer end lowered to move said rod into anchoring position.

When both, parallelogram beam and thereto attached rod, are in their extreme downward position the maximal available depth of the system is achieved, in most cases for example 8 feet, if the length of the main beam is 4 feet, and that of the rod 4 feet as well. If a larger depth is desired, say 10 feet, an anchor with a main beam of 5 feet and a rod of 5 feet is required.

Provisions to extend the reach to the rod are shown in the patent incorporated by reference, where the rod is attached to the outer short leg of the parallelogram beam in a clamp mechanism (14). To slide the rod into an extended configuration, clamping screw (15) can be loosened to allow the rod to be moved down by at least a portion of its entire length, thereby extending its downward reach by about, say, an extra foot. It requires the operator to loosen the claim by hand, slide out the rod, and re-tighten the clamp before the anchor can be lowered into the water. This operation can be performed automatically by using the relative motion of the parallelogram parts, which is the core of the present invention.

Figure 2:
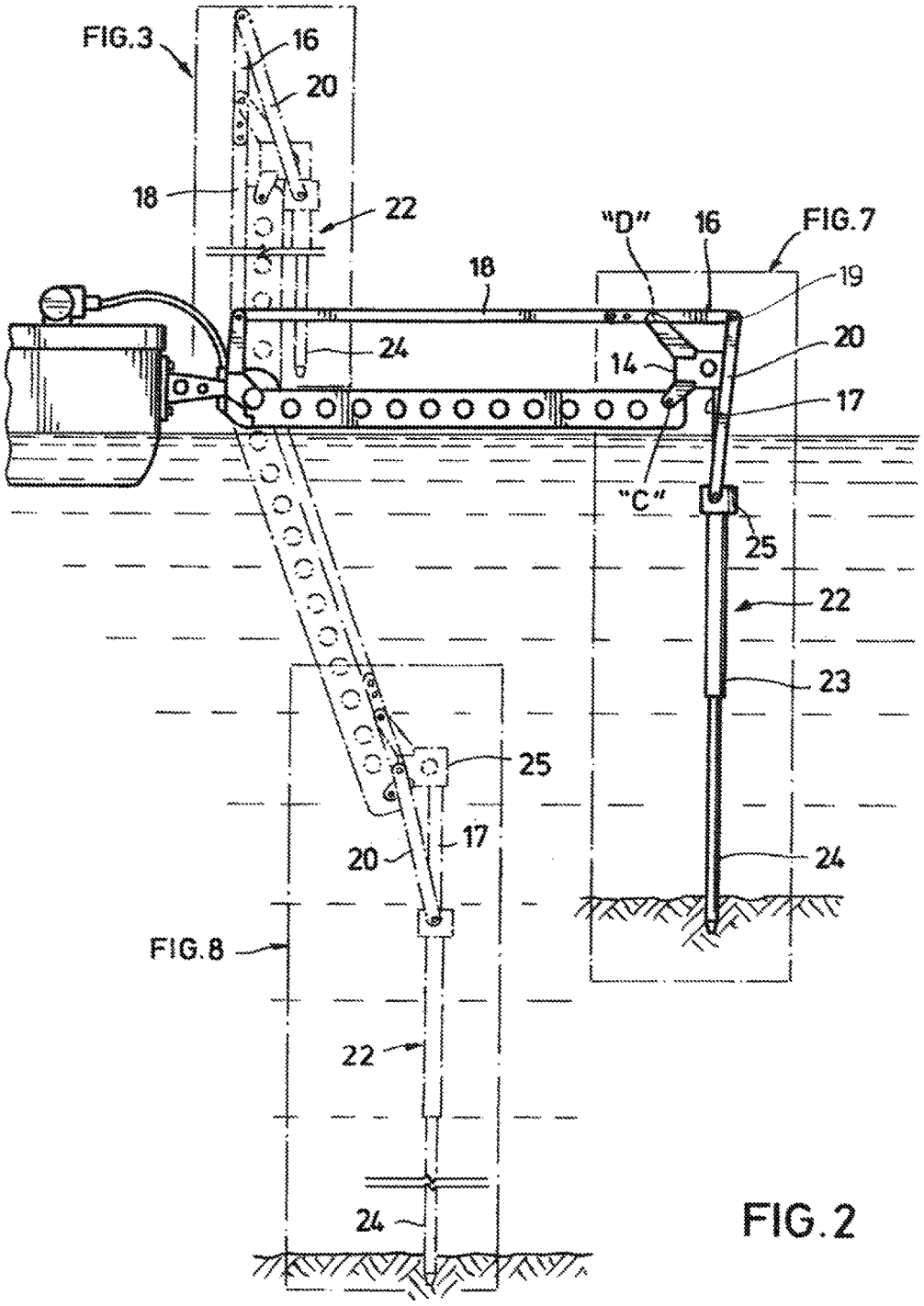
FIG. 2 illustrates side elevation view of the present invention.
Figure 4:
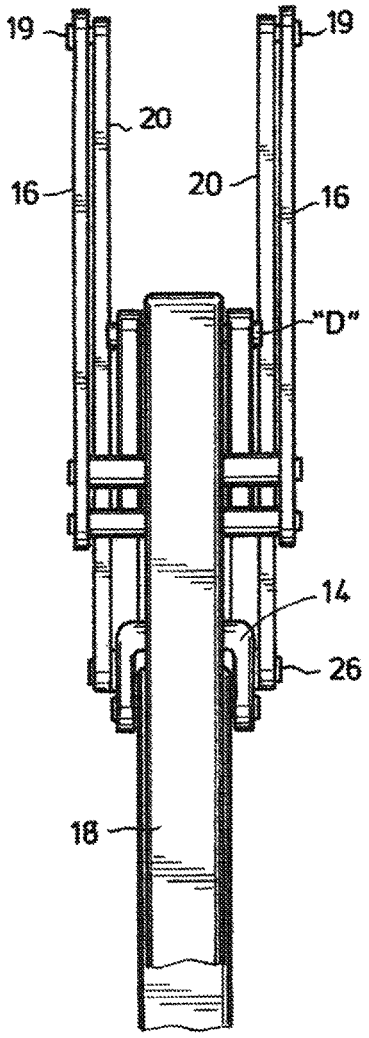
FIG. 4 illustrates left side view of FIG. 3.
Figure 3:
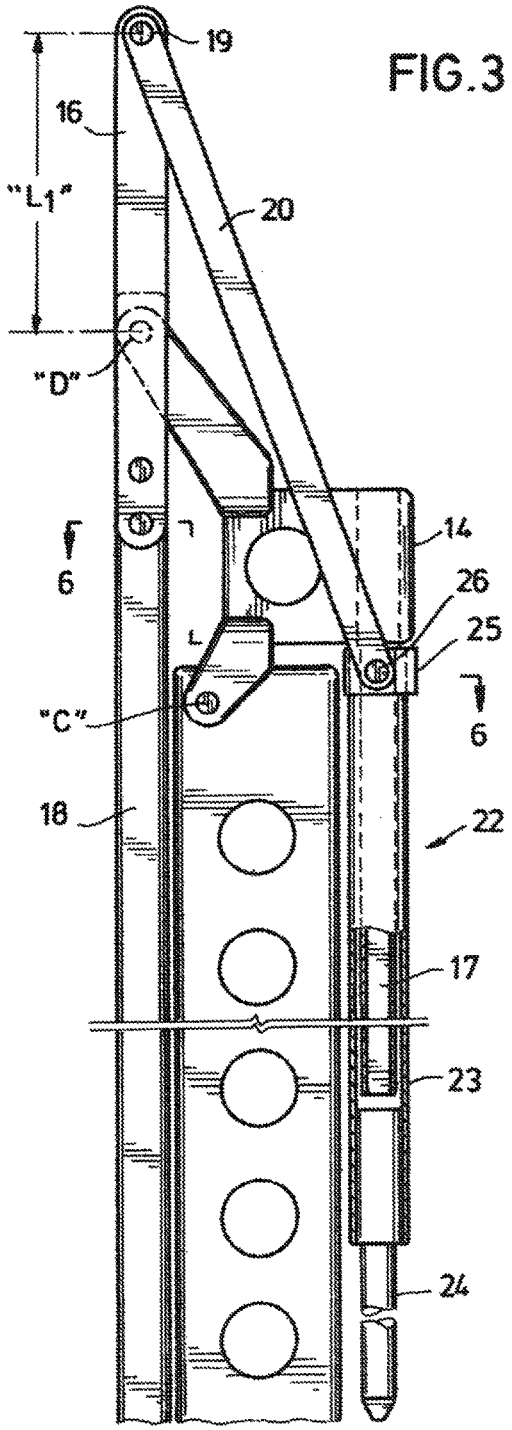
FIG. 3 illustrates enlarged detail as indicated in FIG. 2.
Figure 5:
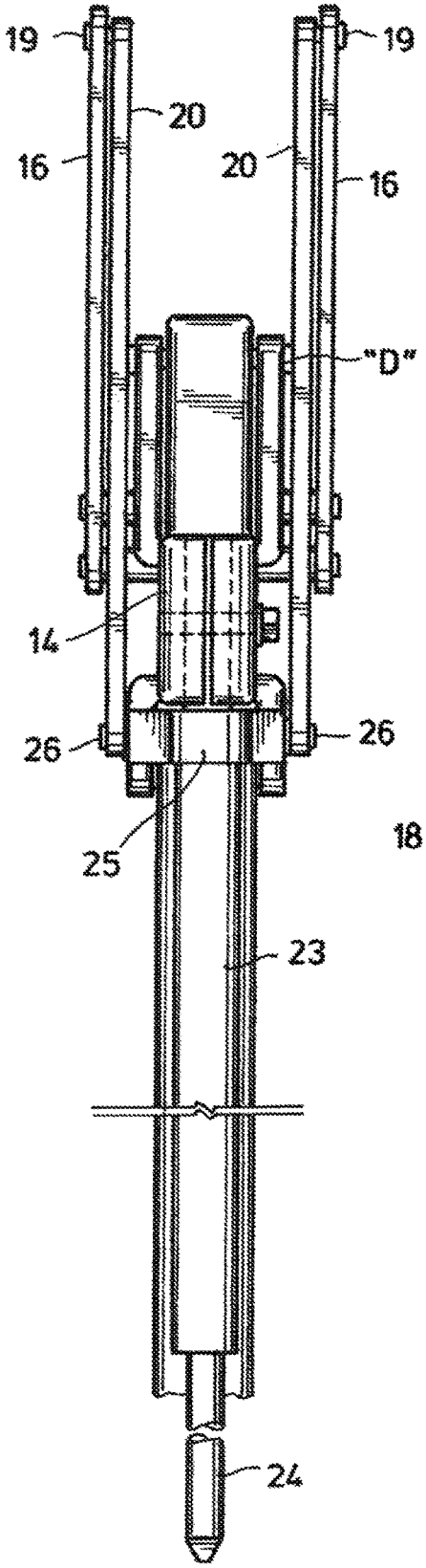
FIG. 5 illustrates right side view of FIG. 3.

Referring to FIGS. 2 and 3, extensions (16) to one of the longer (18) of the parallelogram beam, providing a pivot point (19) beyond the point "D" by a distance of "L1". Rod (11) here is replaced by a telescoping mechanism (22), consisting of a square tube (17), which is slidably surrounded by round tube (23). The lower end of tube (23) connects to a semi-flexible rod (24), its upper end connects to saddle pieces (25), which provides pivot point (26).

Pivot pints (19) and (26) are connected by rods (20). As shown in FIG. 3, saddle piece (25) is situated close to clamp (14), when the anchor is in its uppermost storage position.

Figures 7, 10:
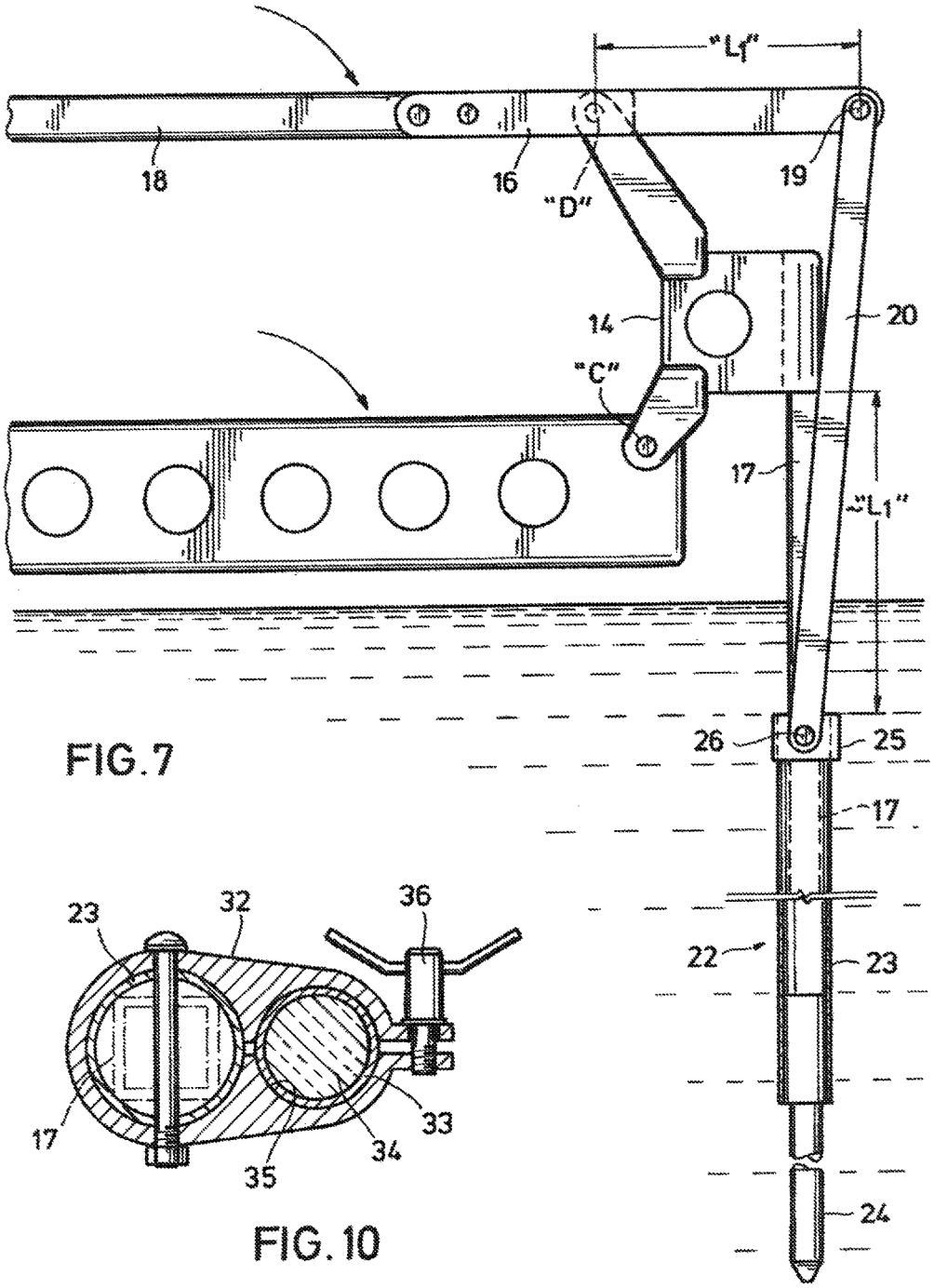
FIG. 7 illustrates enlarged detail as indicated in FIG. 2.
FIG. 10 illustrates cross section as indicated in FIG. 9.

FIG. 7 shows the anchor rotated down by 90 degrees in a horizontal position. Pivot point (19) has moved around pivot point "D" by 90 degrees, downward by extension "L1", pushing telescoping tube (22) and rod (24) down by approximately the length "L1".

Figures 8, 9, 11:
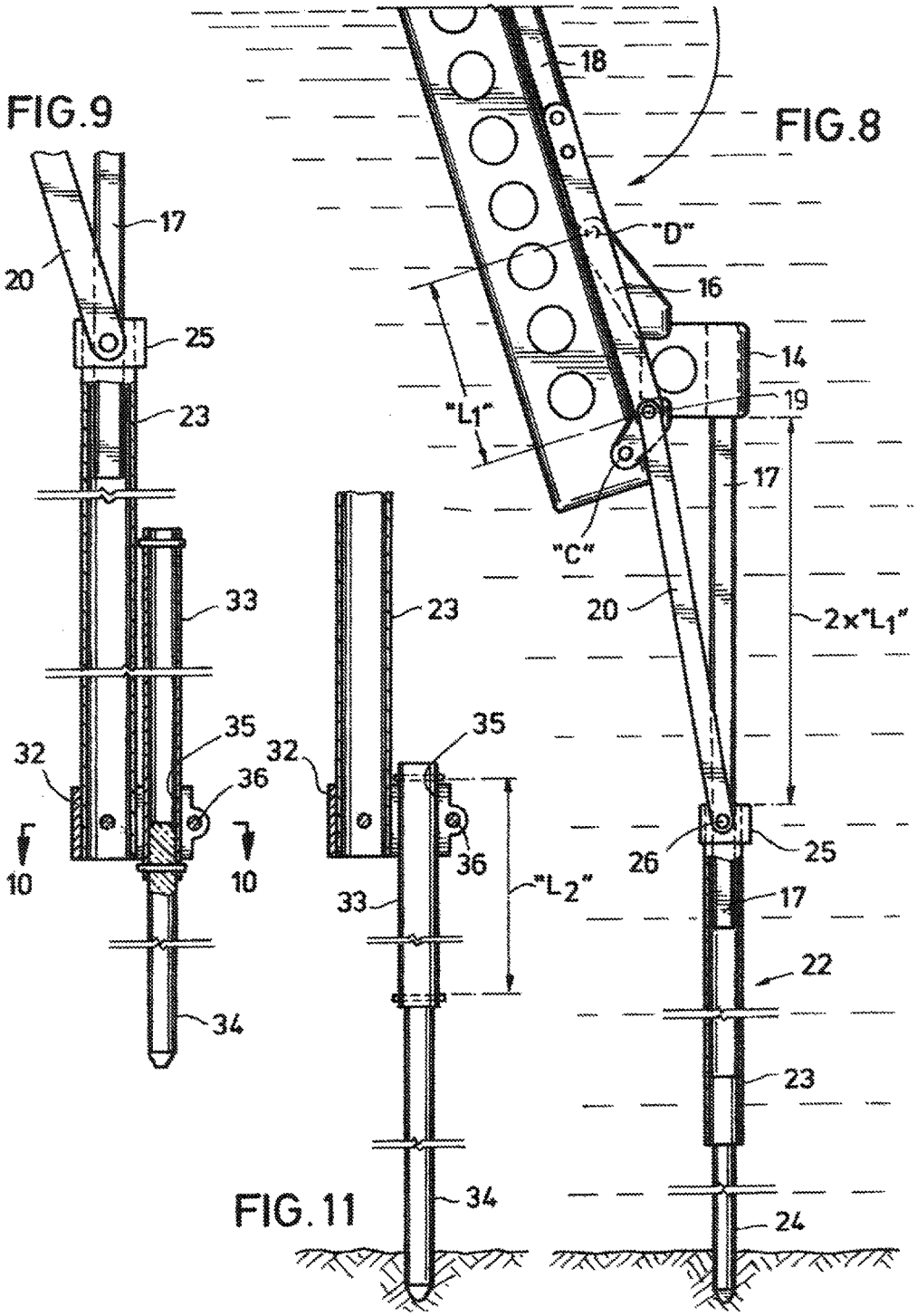
FIG. 8 illustrates enlarged detail as indicated in FIG. 2.
FIG. 9 illustrates an alternative attachment in retracted storage position.
FIG. 11 illustrates alternative attachment in extended position.

FIG. 8 show the anchor rotated down about 170 degrees, the total length of the bottom touching rod extended by 2×"L1" (minus about 2 inches due to the mechanical limitations of the parallelogram).

Figure 6:
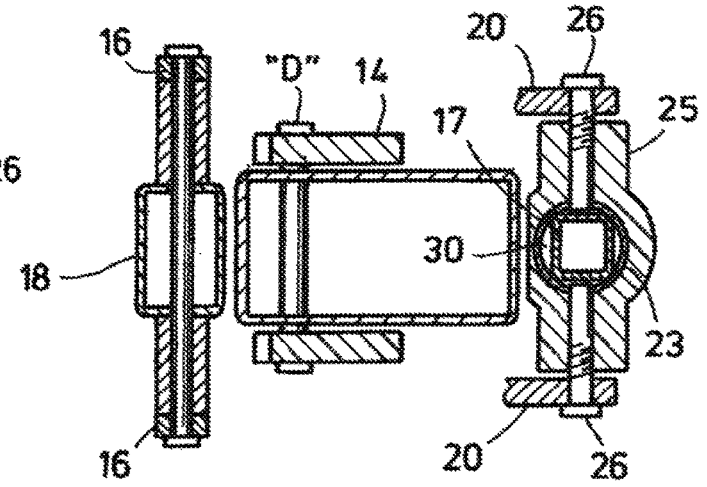
FIG. 6 illustrates cross-section as indicated in FIG. 3.

FIG. 6 illustrates in cross-section details of the saddle piece (28). The square tube (17), telescoping inside tube (23) leaves four half-moon shaped openings (30), which allow space for any dirt or sand to accumulate and get flushed out easily without the two telescoping members getting stuck due to increased friction.

Referring to FIGS. 9, 10 and 11, rod (24) here has been removed. Instead clamp (32) is installed to the lower end of tube (23). Slidably mounted inside a parallel passage (35) is a tube (33), which connects to a semi-flexible rod (34). Tube (33) can be extended down by an additional length "L2" and locked into place by tightening crank (36).

If "L2" is chosen to be 12 inches, plus the automatic extension of 12 inches, a basic 8 feet anchor is easily converted into a 10 foot anchor without the expense of an entirely different enlarged model. An added advantage is the possibility to add one or both conversions later.

Figures 12, 13, 17, 18, 19:
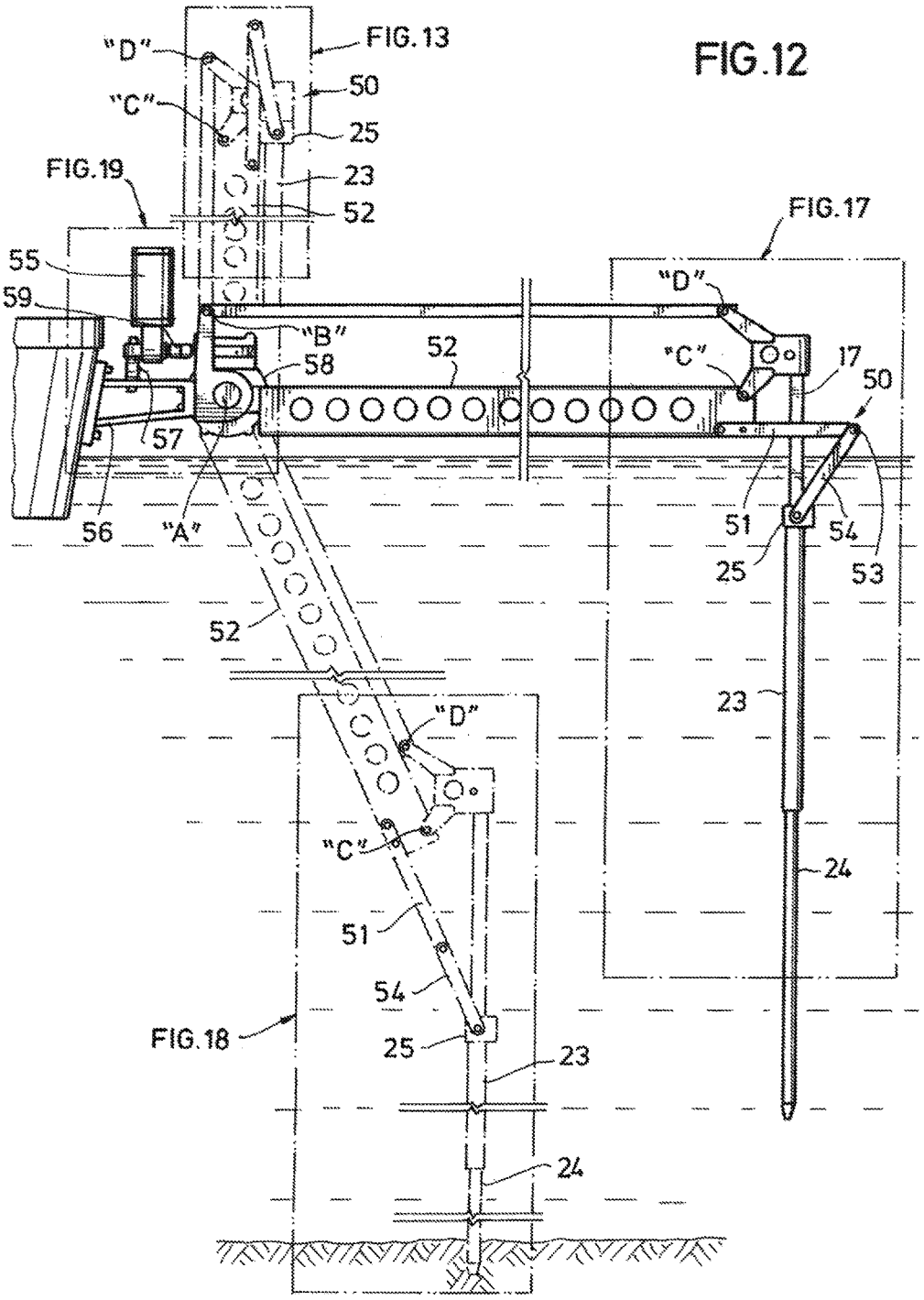
FIG. 12 illustrates side elevation view of an alternative rod extension.
FIG. 13 illustrates enlarged detail view as indicated in FIG. 12.
FIG. 17 illustrates enlarged detail view as indicated in FIG. 12.
FIG. 18 illustrates enlarged detail view as indicated in FIG. 12.
FIG. 19 illustrates enlarged detail view as indicated in FIG. 12.

FIG. 12 illustrates an alternative linkage design (50). Here an extension (51) is attached to main beam (52), to which outer end (53) is connected link (54), thus connecting pivot point (53) to the upper end (25) of outer telescoping tube (23). Furthermore FIG. 12 illustrates an electric gear motor (55) mechanically connected to main bracket (56) via a vibration dampening spring device (57), wherein its output shaft transmits torque to the main worm gear (58) via a flexible coupling (59).

Figure 14:
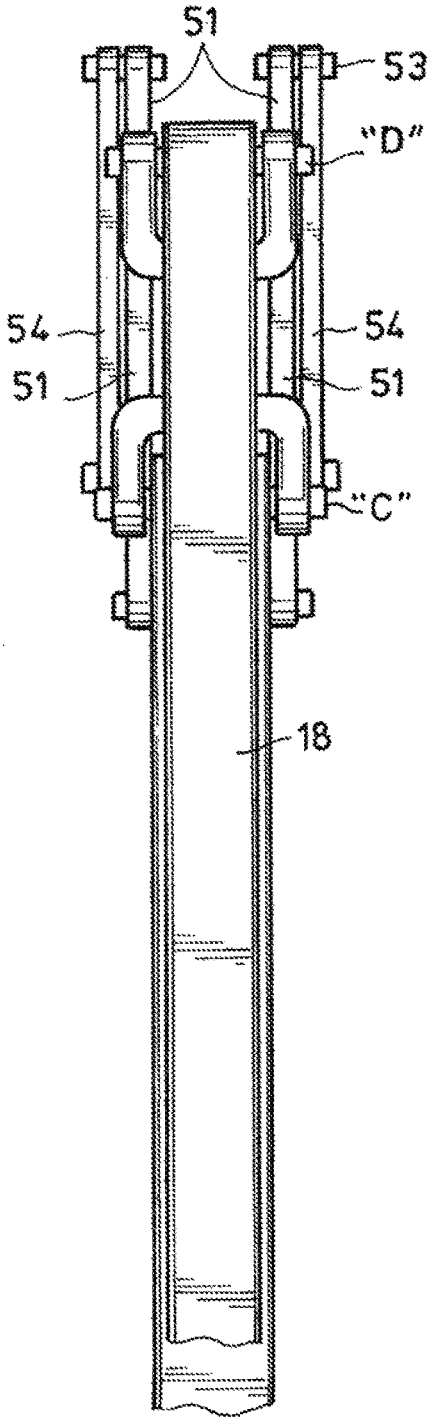
FIG. 14 illustrates left side view of FIG. 13.
Figure 13:
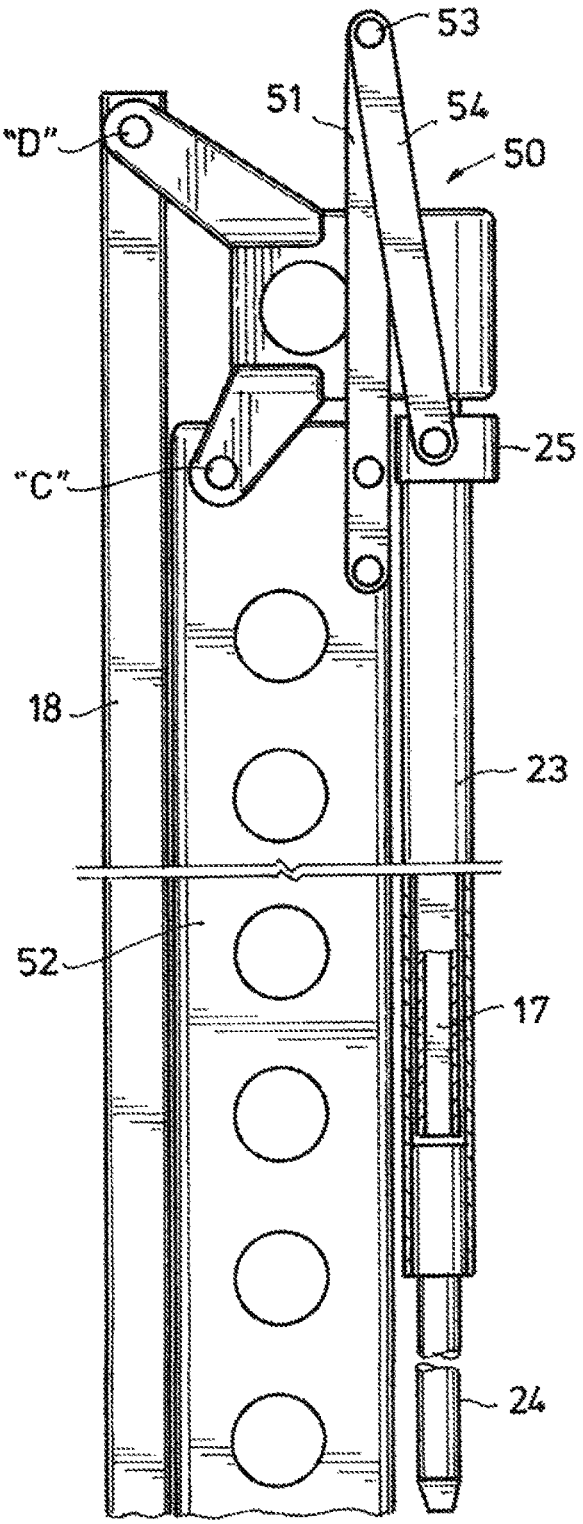
Figure 17:
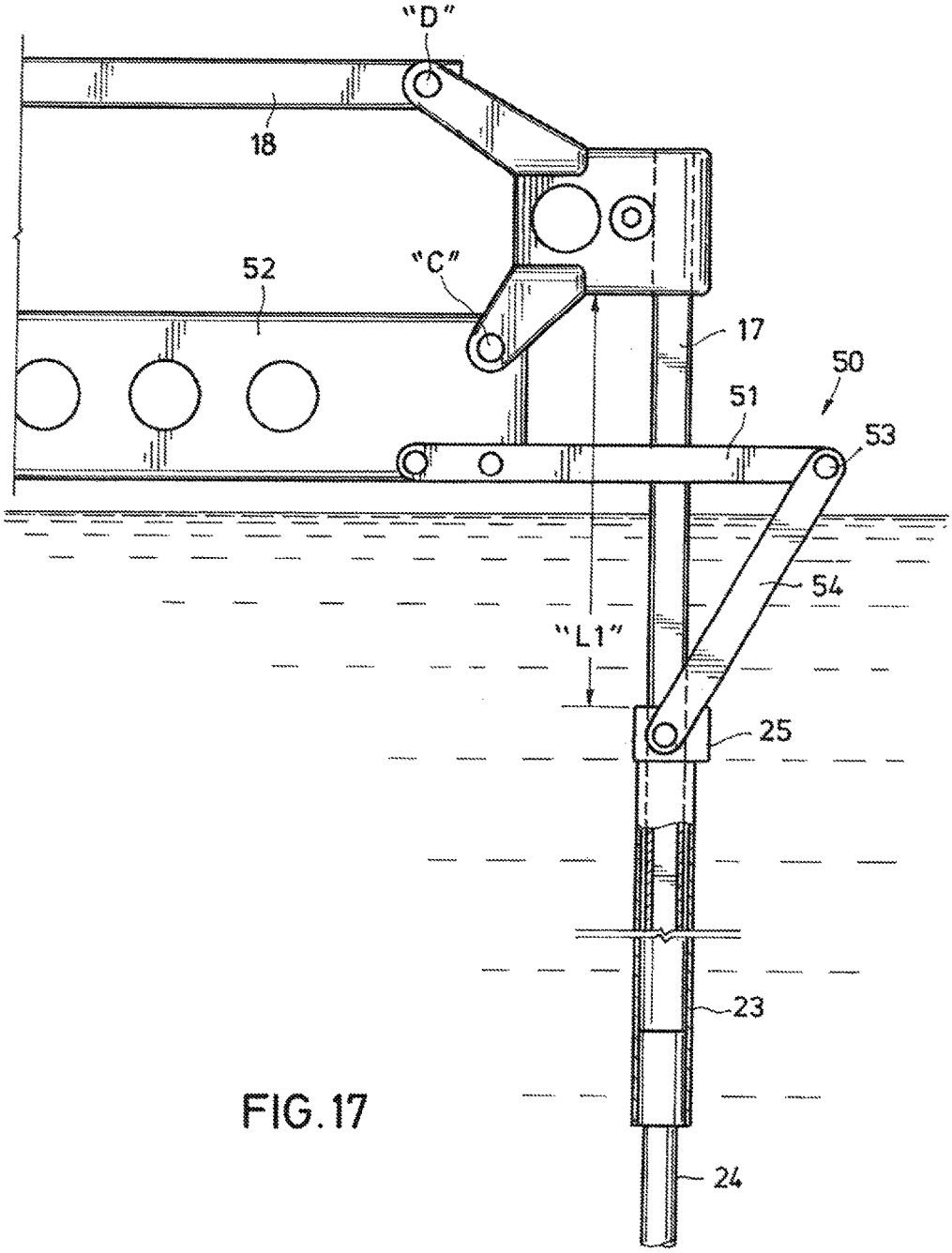
Figure 18:
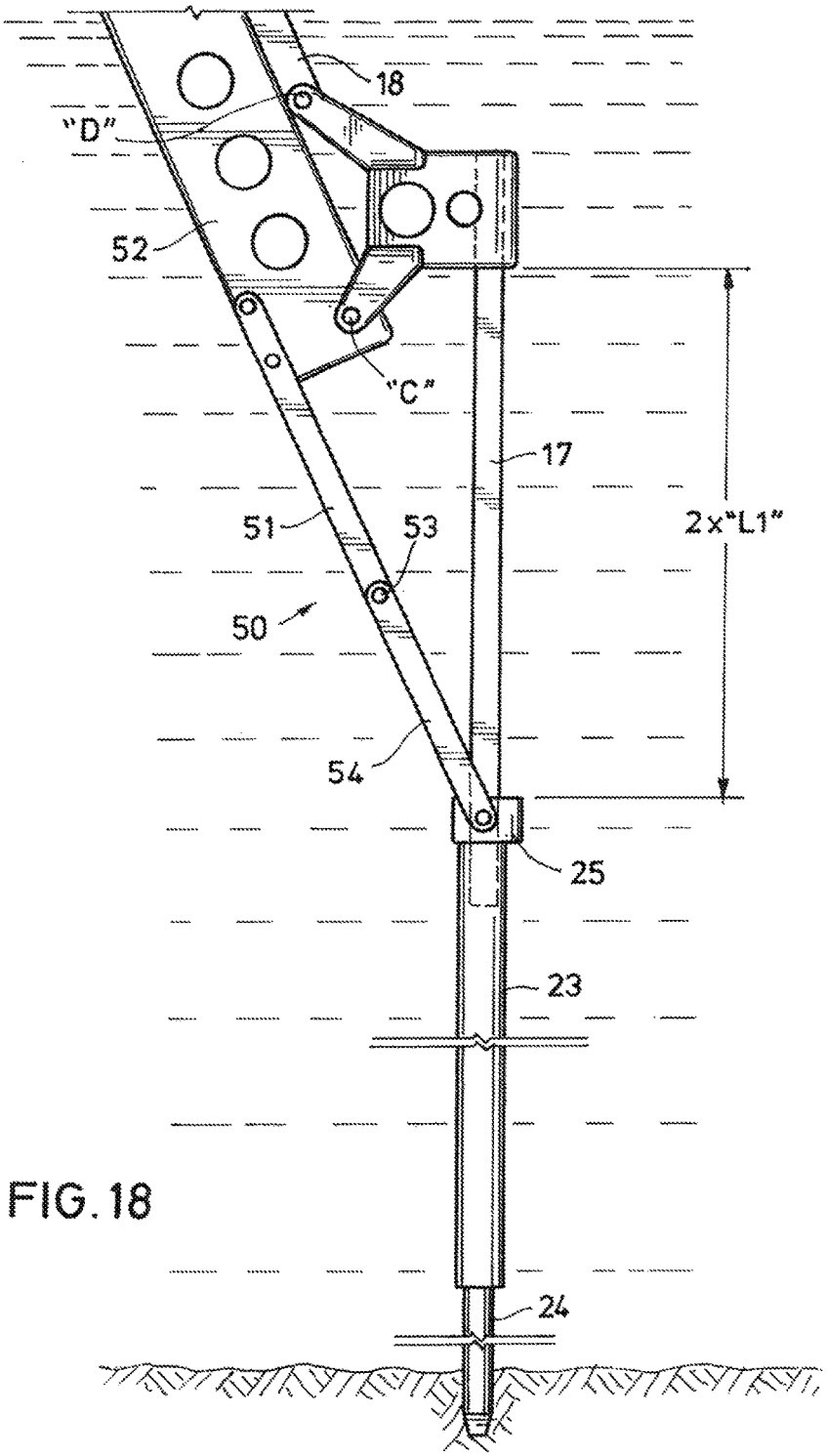
Figure 19:
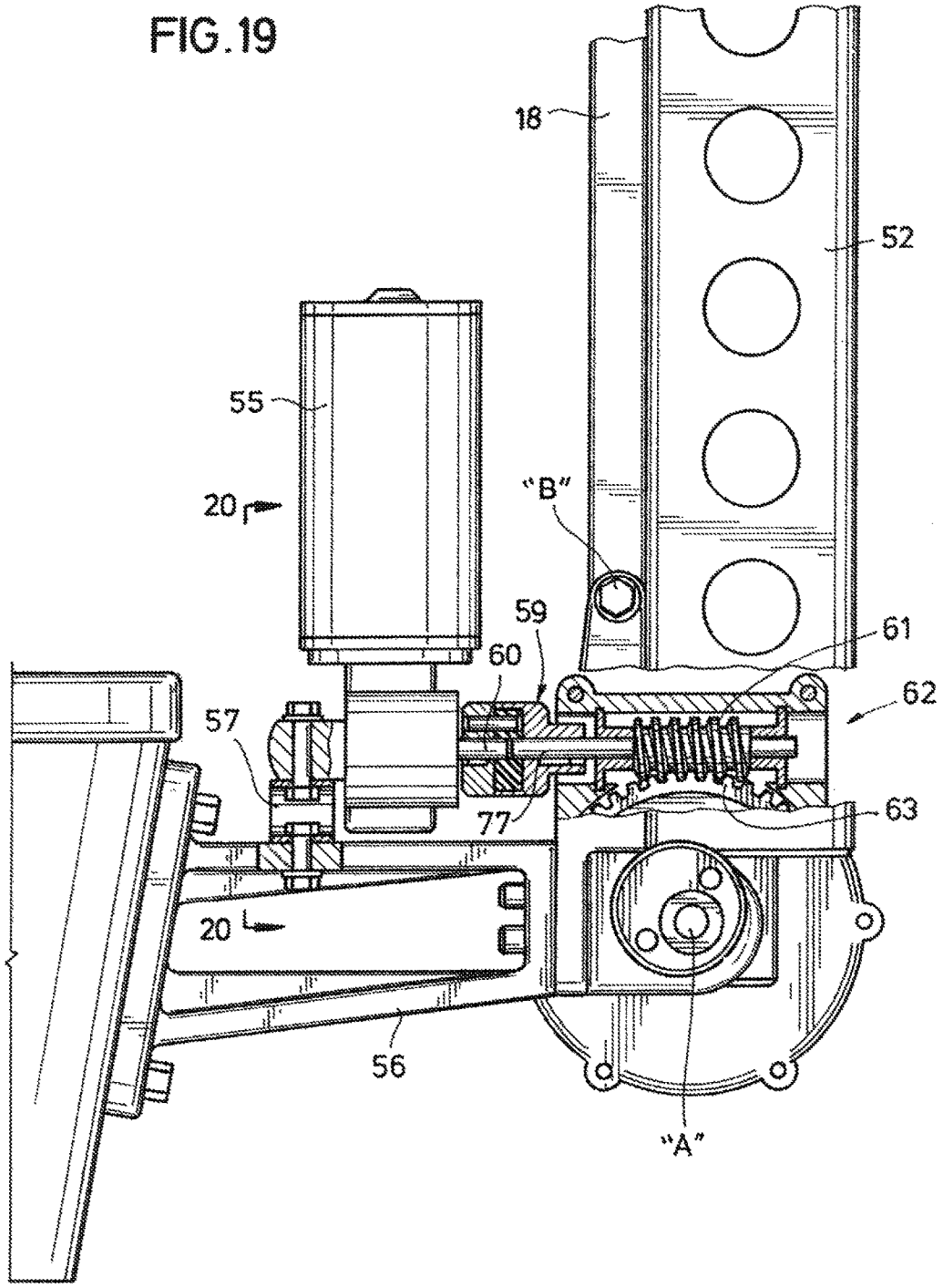

FIGS. 13 and 14 illustrate the position of the extension linkage (50) in its storage position, the outer telescoping tube in its fully retracted position.

FIG. 15 is a right side elevational view of FIG. 13, and FIG. 16 a top view of FIG. 13 in a somewhat larger scale.

FIG. 17 shows the main beam (52) in a partially deployed position, the outer telescoping tube (23) partially moved down on the inner telescoping tube (17) by the length of "L1".

In FIG. 18 the main beam (52) has been moved into its downward end position, linkages (51) and (54) in an approximately straight line, thus pushing tube (23) to its fullest extension of 2×L1.

Referring to FIG. 19, an electric gear motor (55) is shown attached to main mounting bracket (56) via flexible spring design (57), thus preventing vibration and humming sounds from reaching the hull of the boat, to which the main bracket (56) is bolted. The output shaft (60) of the motor rotates the worn (61) of the work gear (62) through a flexible coupling (59), avoiding metal-to-metal contact, thus here too preventing transmission of vibration noises. Gear (63) is attached to main beam (52) as described in U.S. Pat. No. 9,284,024.

Figure 20:
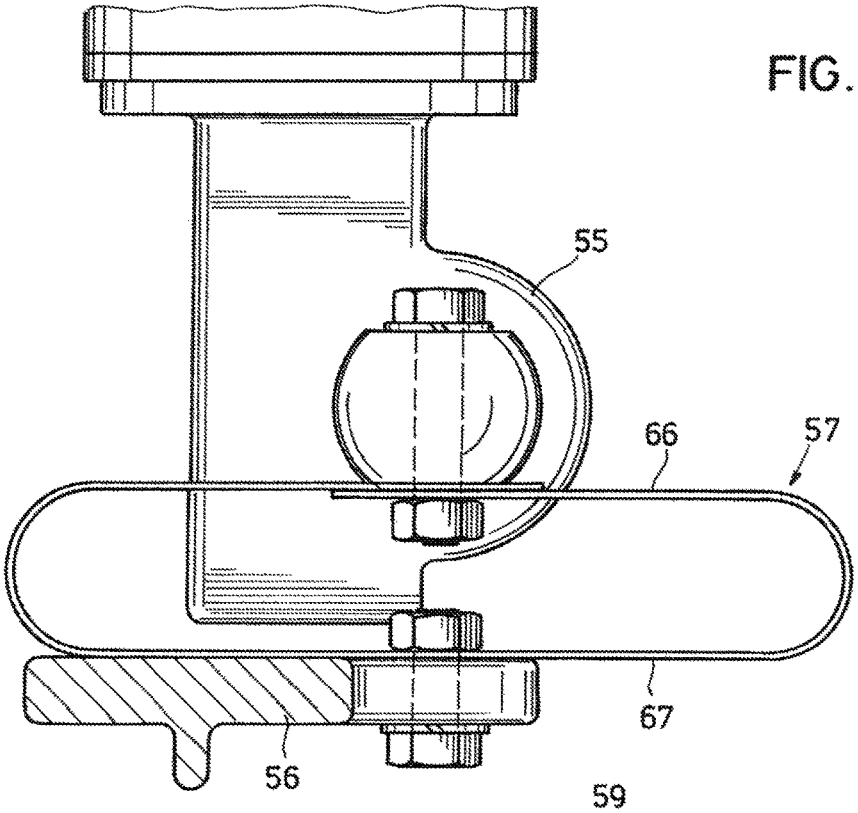
FIG. 20 illustrates enlarged cross section as indicated in FIG. 19.

FIG. 20, as indicated as cross-section in FIG. 19, illustrates the above mentioned leaf spring (57) and how it is located between gear motor (55) and main bracket (56). The side (66) of spring (57) is vibrating with the motor (55), but this vibration is not transmitted to the lower half (67) of the spring, and thus the main bracket and the boat are not affected.

Figure 21:
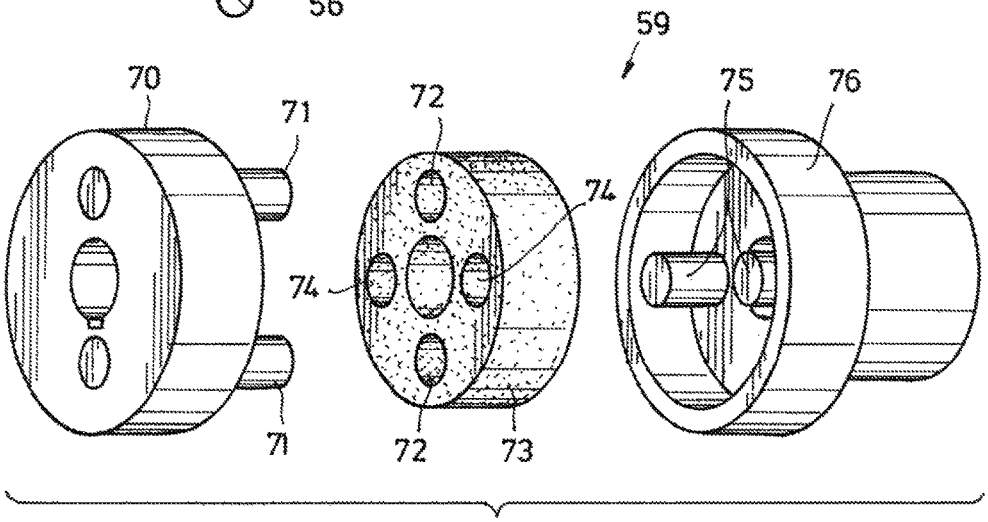
FIG. 21 illustrates exploded perspective view of a flexible motor coupling.

FIG. 21 shows the individual parts of the flexible coupling (59). Disc (70), which is driven by the output shaft (60) of the gear motor, is equipped with two pins (71), which engage holes (72) in rubber disk (73). Holes (74) are being engaged by pins (75), which are parts of coupler (76). Coupler (76) is keyed to shaft (77) of worm gear (62). Contact between (70) and (76) exists only though the rubber part (73), thereby eliminating metal-to-metal contact and noise transmission. This arrangement also serves to bridge the effects of mechanical misalignment between the two shafts (60) and (77).

Figure 22:
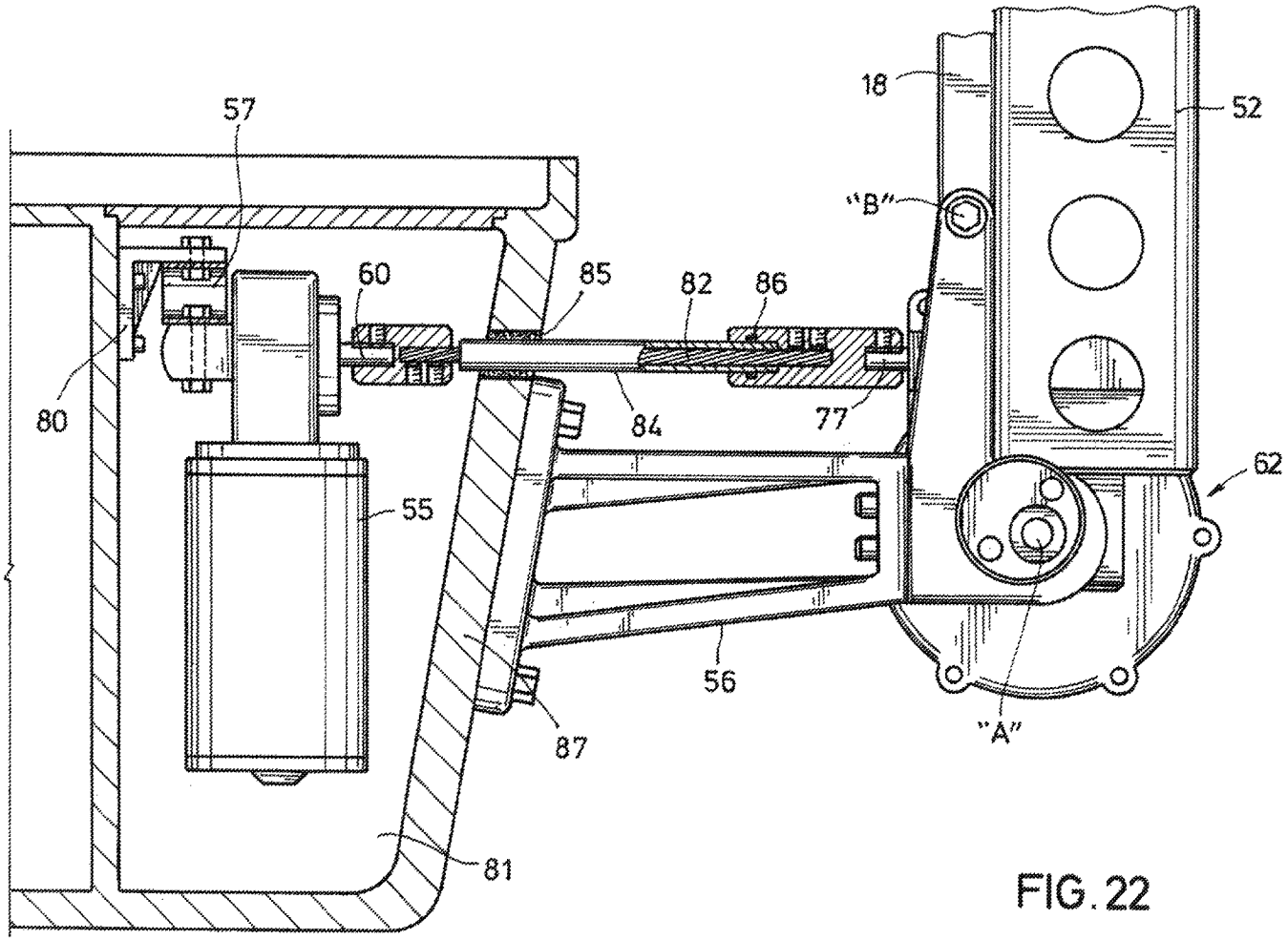
FIG. 22 illustrates an alternative motor drive detail.

Referring to FIG. 22, gear motor (55) is mounted via the same leaf spring (57) and a bracket (80) inside of one of the boat compartments (81). Here, the boat compartment serves to dampen the humming noises of the motor. The output shaft (60) of motor (55) and input shaft (77) of the main gear (62) are connected by a flexible shaft (82), which rotates inside of shield (84). Shield (84) penetrates the transom wall (87) of the boat through hole (85) and is water sealed by caulking. Water is prevented from entering the inside of the shield by O-ring (86).

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

What I claim:

1. In a shallow-water anchor configured to be mounted to a substantially vertical or slightly angled exterior surface of a boat, the anchor including a parallelogram beam having a primary beam, a secondary beam parallel to the primary beam, a first connecting arm, and a second connecting arm parallel to the first connecting arm, the primary beam, the secondary beam, the first connecting arm, and the second connecting arm coupled together to form a parallelogram, with a mounting base rigidly affixed to the first connecting arm so that the first connecting arm remains in a vertical position, the mounting base configured to be mounted to a substantially vertical or slightly angled exterior surface of a boat, an improvement comprising:

a vertical rod forming the inner part of a telescope, joined to the second connecting arm, so that the rod remains in a vertical position when mounted to the boat;

an outer telescoping tube positioned on the vertical rod in a sliding manner, connecting at a lower end to a semi-flexible fiberglass rod;

an extension rod fixedly attached to outer end of the primary beam or the secondary beam, extending outwardly beyond connecting points of the beam with the connecting arm; and a link connecting the outer end of said extension rod and the upper end of the outer telescoping tube.

2. The anchor of claim 1 including the vertical rod forming the inner part of the telescope comprising an inner telescope of a multi-flat-sided tube with rounded corners within an outer circular tube surrounding the inner tube in a sliding fit.

3. The anchor of claim 1 including the anchor comprising the primary beam connected to a worm gear driven by a gear motor, the connection between the worm gear and the gear motor including a flexible coupling means.

4. The anchor of claim 3 comprising an oval shaped leaf spring positioned between the gear motor and a main mounting base.

* * * * *